US012560397B2

(12) United States Patent
Landis et al.

(10) Patent No.: US 12,560,397 B2
(45) Date of Patent: Feb. 24, 2026

(54) RIFLE BIPOD ASSEMBLY

(71) Applicant: Sig Sauer, Inc., Newington, NH (US)

(72) Inventors: Tanner J. Landis, Dover, NH (US); Andrew P. Loriot, Somersworth, NH (US); Rich Curley, Dover, NH (US); Christoper B. D'Alfonso, Exeter, NH (US); Zachary A. Amico, Danville, NH (US)

(73) Assignee: Sig Sauer, Inc., Newington, NH (US)

( * ) Notice: Subject to any disclaimer, the term of this patent is extended or adjusted under 35 U.S.C. 154(b) by 411 days.

(21) Appl. No.: 18/162,102

(22) Filed: Jan. 31, 2023

(65) Prior Publication Data

US 2023/0243614 A1 Aug. 3, 2023

Related U.S. Application Data

(60) Provisional application No. 63/304,783, filed on Jan. 31, 2022.

(51) Int. Cl.
*F41A 23/08* (2006.01)
*F41A 23/10* (2006.01)

(52) U.S. Cl.
CPC ..... *F41A 23/08* (2013.01); *F41A 23/10* (2013.01)

(58) Field of Classification Search
CPC ..... F41A 23/08; F41A 23/10
See application file for complete search history.

(56) References Cited

U.S. PATENT DOCUMENTS

| | | | | | |
|---|---|---|---|---|---|
| 2,375,721 | A * | 5/1945 | Woodhull | F41A 13/12 | 89/149 |
| 2,489,283 | A * | 11/1949 | Garand | F41A 23/08 | 42/94 |
| 4,416,186 | A * | 11/1983 | Sullivan | F41A 3/66 | 89/198 |
| 5,711,103 | A * | 1/1998 | Keng | F41A 23/08 | 89/37.04 |
| 6,763,627 | B1 * | 7/2004 | Kaempe | F41A 23/10 | 89/37.04 |
| 7,631,455 | B2 * | 12/2009 | Keng | F41A 23/10 | 248/163.1 |
| 2005/0188597 | A1 * | 9/2005 | Keng | F41A 23/08 | 42/94 |

(Continued)

FOREIGN PATENT DOCUMENTS

| | | | |
|---|---|---|---|
| DE | 684688 C | * | 12/1939 |
| DE | 736218 C | * | 6/1943 |

(Continued)

*Primary Examiner* — Gabriel J. Klein
(74) *Attorney, Agent, or Firm* — Finch & Maloney PLLC

(57) ABSTRACT

A bipod assembly includes a first yoke configured to be attached to a firearm. A second yoke is pivotably attached to the first yoke. Right and left legs are pivotably connected to the second yoke and movable between an open position and a closed position. The bipod assembly is movable between a stowed and locked position, a stowed and unlocked position, a deployed and unlocked position, and a deployed and locked position. In a locked position, part of each leg engages the first yoke to maintain the leg's open or closed position as well as the leg's deployed or stowed position. The bipod assembly enables one-hand deployment from a stowed state.

16 Claims, 15 Drawing Sheets

(56) References Cited

U.S. PATENT DOCUMENTS

| | | | | |
|---|---|---|---|---|
| 2005/0242250 | A1* | 11/2005 | Keng | F16M 11/26 248/512 |
| 2006/0278797 | A1* | 12/2006 | Keng | F16M 11/26 248/440.1 |
| 2008/0222936 | A1* | 9/2008 | Moody | F41C 23/16 42/73 |
| 2010/0307046 | A1* | 12/2010 | Cheng | F41C 27/22 42/94 |
| 2012/0266513 | A1* | 10/2012 | Gnesda | F41C 23/12 42/71.01 |
| 2023/0243614 | A1* | 8/2023 | Landis | F41A 23/08 42/94 |
| 2023/0383896 | A1* | 11/2023 | Davidson | F16M 11/041 |

FOREIGN PATENT DOCUMENTS

| | | | | |
|---|---|---|---|---|
| EP | 0127193 | A1 * | 12/1984 | F41A 23/08 |
| GB | 2090951 | A * | 7/1982 | F41A 3/66 |
| PL | 109434 | B1 * | 5/1980 | |

* cited by examiner

RIFLE BIPOD ASSEMBLY

RELATED APPLICATIONS

This application claims the benefit under 35 U.S.C. § 119(e) of U.S. Provisional Patent Application No. 63/304,783 titled RIFLE BIPOD ASSEMBLY, and filed on 31 Jan. 2022, the contents of which are incorporated herein by reference in its entirety.

TECHNICAL FIELD

The present disclosure relates generally to accessories and attachments for rifles, and more particularly to a bipod assembly for a rifle.

BACKGROUND

A bipod is a two-legged portable attachment that can be attached to the fore end of a rifle to support and steady the rifle during use. The bipod has been useful to increase the shooter's accuracy with machine guns and other rifles as well as to maintain the rifle in a shooting-ready position. The bipod includes two legs that extend laterally down from the rifle when the bipod is deployed. Some bipods have a fixed position or leg length while others are adjustable and have legs that can fold and/or telescope independently for use on uneven terrain. Feet of the bipod can be made of various materials, including rubber, metal, and basket-type structures designed to provide grip and to prevent the bipod from sinking into sand, snow, and other soft surfaces.

SUMMARY

Disclosed is a bipod assembly for a firearm. In accordance with an embodiment, the bipod assembly includes a dual-yoke structure that enables the user to move the legs between stowed and deployed positions using one hand. The bipod assembly also can provide improved reliability in maintaining a deployed or stowed position.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
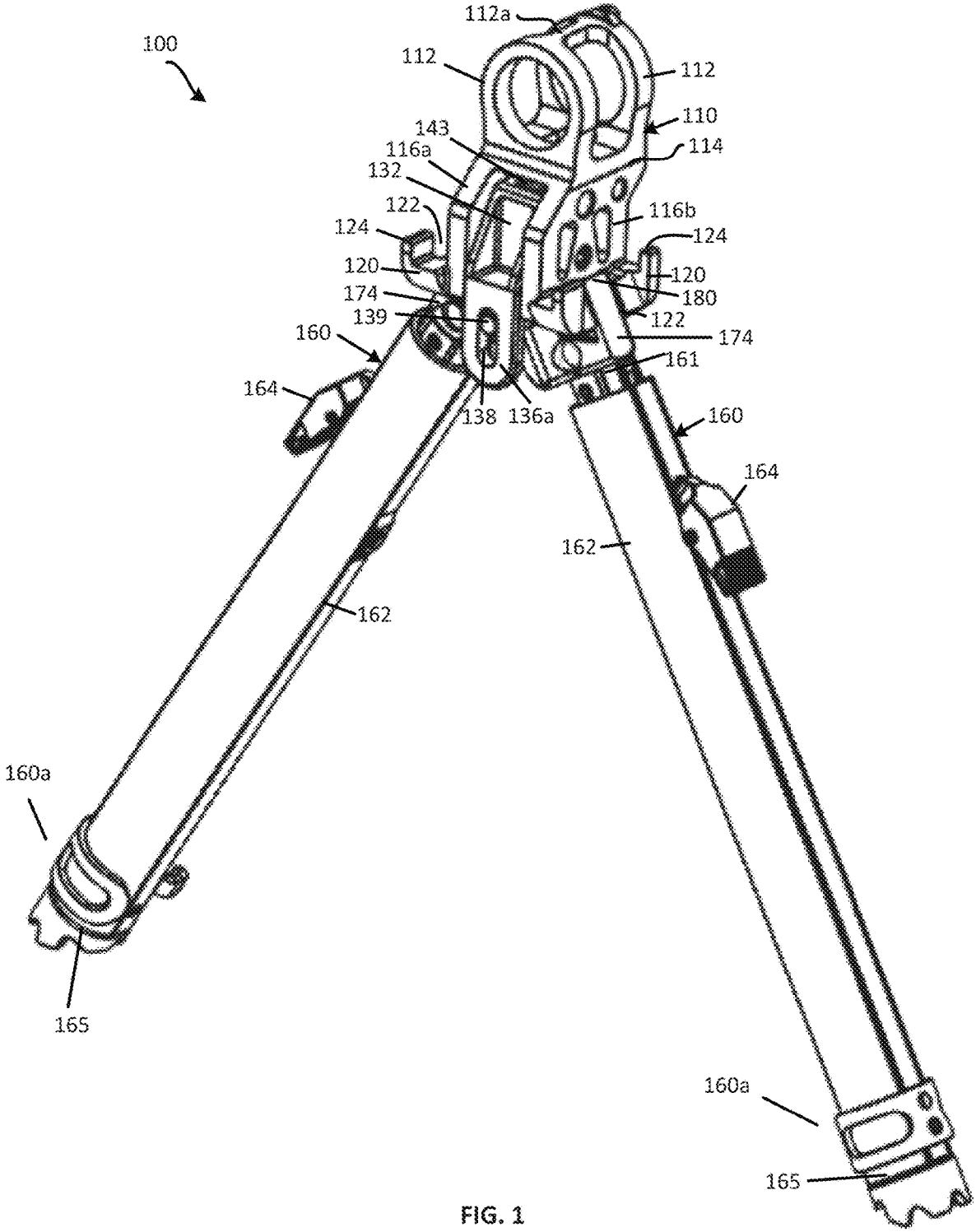
FIG. 1 illustrates a front perspective view of a bipod assembly in a deployed and locked position, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a bipod for use with firearms, such as a long-range rifle or a machine gun. In accordance with one embodiment, the bipod assembly includes a first yoke that attaches to the rifle and has right and left plates that extend down from the yoke body. A second yoke is attached to the first yoke between the left and right plates of the first yoke. The second yoke has front and rear arms that extend down. The second yoke can pivot about a pin that extends through the body of the second yoke and through the plates of the first yoke. Right and left legs attach to a pin that can move along the arms of the second yoke. In such manner, the legs can be moved between stowed and deployed positions.

The legs are movable between a closed position (e.g., extending away from the second yoke in parallel) and an open position (e.g., extending away from the second yoke in diverging directions). A connecting pin passes through a connector at the top of each leg, where the connecting pin extends can travel along the arms of the second yoke. For example, the connecting pin can travel along arms of the second yoke by having its ends received in slots or channels defined in the arms. A spring biases the connecting pin to a proximal or locked position so that the arms are urged to return to the locked position when released.

In the proximal or locked position, the upper end of each leg connector is configured to engage the respective right or left plate of the first yoke to lock the legs in either a deployed or stowed position. For example, the connector engages the plate along its bottom edge when legs are deployed and locked, preventing inadvertent closing of the legs. In a stowed and locked position, a tooth on each connector can be received in a gap between the plate and a foot extending outward from the plate, thus preventing inadvertent movement of the legs to the open position or inadvertent pivot of the legs to the deployed position. The user can pull the legs away from the second yoke (e.g., along the rifle's barrel) to disengage the teeth from the gaps on the first yoke and to allow the second yoke and legs to pivot to the deployed position. After doing so, the user can release the legs, allowing the legs to open and allowing the second yoke to return to the proximal or locked position.

A bipod assembly as disclosed herein allows the user to deploy or stow the bipod legs using one hand. The bipod assembly provides improved reliability in maintaining a deployed or stowed position. Accordingly, the bipod assembly avoids inadvertent deployment, for example. In each position, for example, the bipod maintains its position due to locking structures between the leg connectors and the first yoke. For example, from a rearward stowed position, in which the legs are maintained in a horizontal and generally parallel position below the rifle barrel, the user can grasp the legs and pull rearwardly to move the second yoke to the unlocked position. Once unlocked, the user may pivot the legs to a deployed position where the legs are oriented about 90° with respect to the barrel, and then release the legs to allow them to spread open and also allow the second yoke to resume the locked position. By returning to the locked position, the leg connectors resume engagement with the first yoke and prevent the legs and second yoke from pivoting out of the deployed position.

Overview

Existing bipods attach to a machine gun below the barrel and utilize a simple pivot to move the legs between deployed and stowed positions. The legs can also pivot laterally between an open position and a closed position. In one example, each leg has a locking mechanism that requires the user to squeeze the upper part of the leg to release the lock. This sometimes requires two hands. The pivot also can allow the bipod to inadvertently deploy, such as when the bipod snags on vegetation. Thus, the bipod can be cumbersome and unreliable in some situations. Accordingly, a need exists for an improved bipod for use with machine guns.

The present disclosure addresses this need and others by providing a rifle bipod assembly utilizing a dual-yoke assembly, in accordance with an embodiment of the present disclosure.

Example Structures

Figure 2:
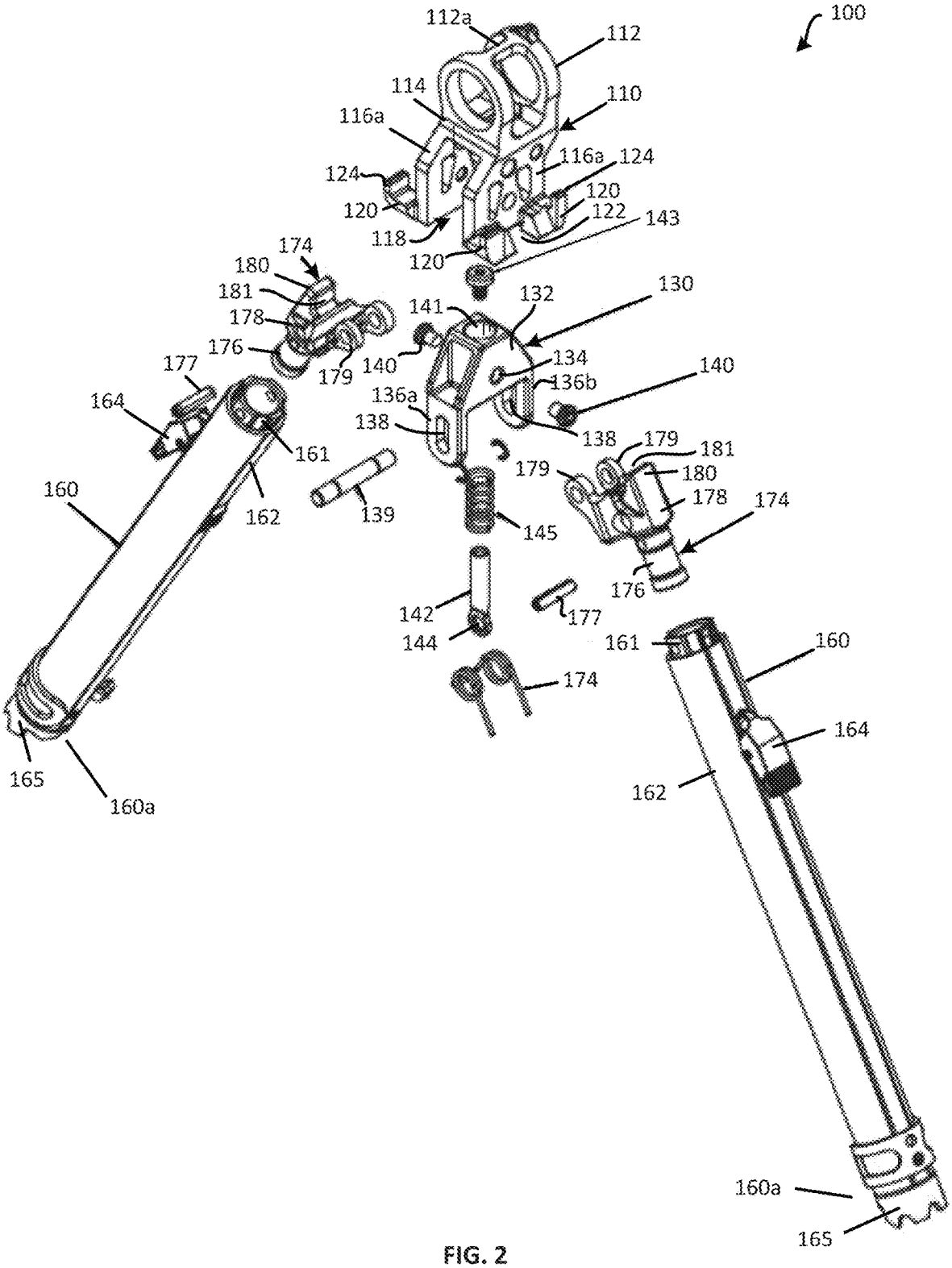
FIG. 2 illustrates an exploded, front, perspective view of showing components of the bipod assembly of FIG. 1.
Figure 3:
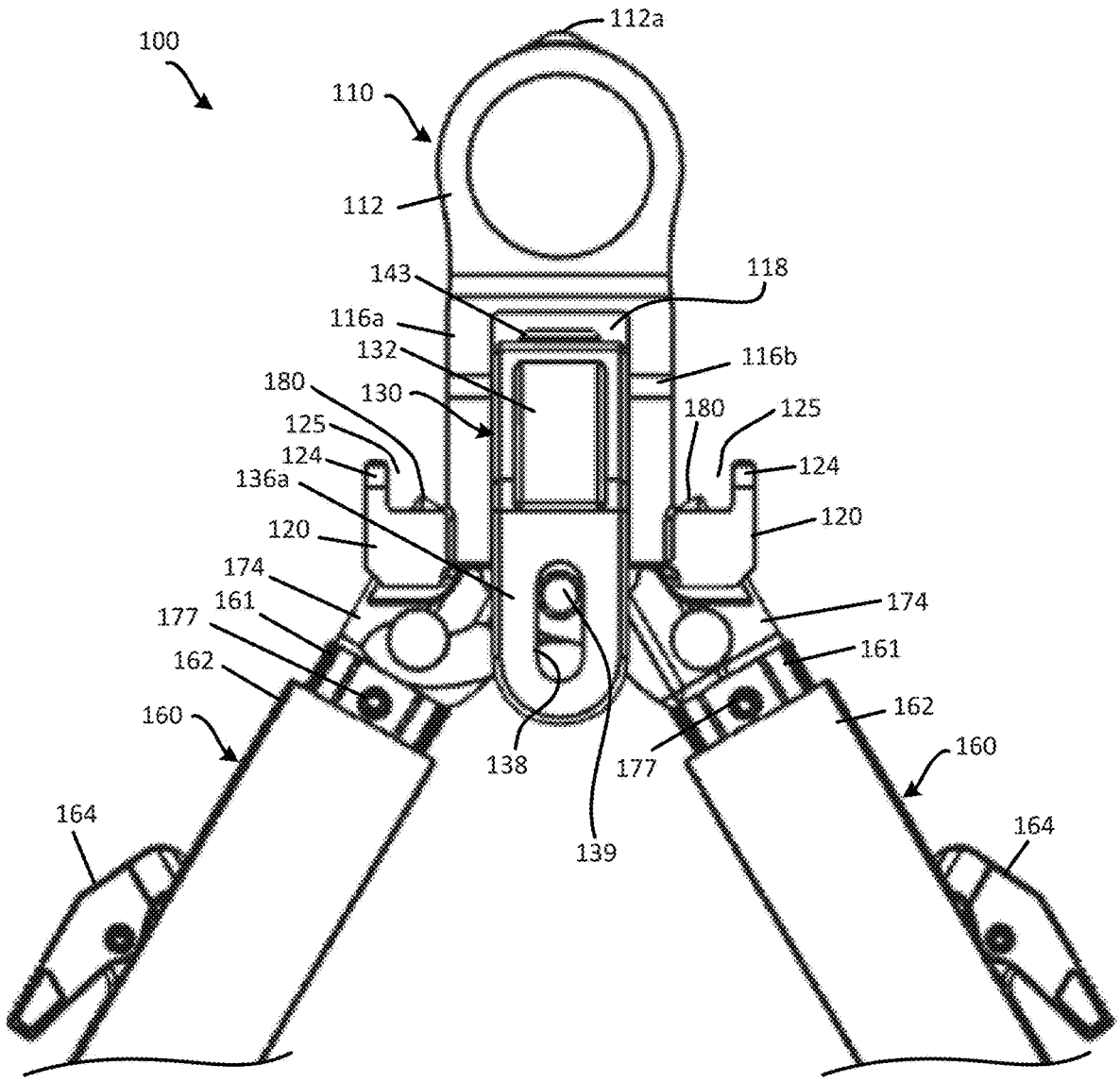
FIG. 3 is a front elevational view showing an upper portion of a bipod assembly in a deployed and locked position, in accordance with an embodiment of the present disclosure.
Figure 4:
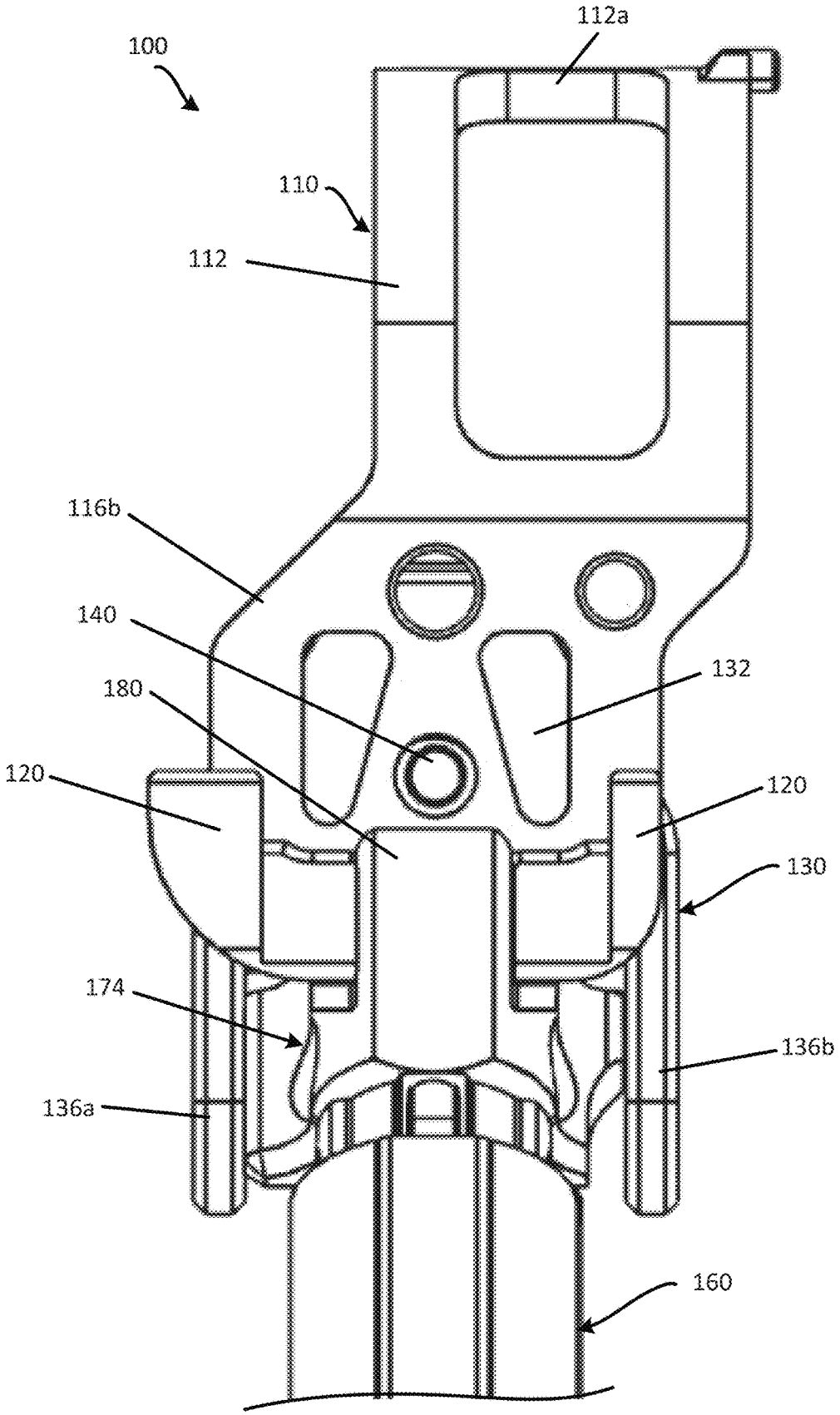
FIG. 4 is a side elevational view showing an upper portion of a bipod assembly in a deployed and locked position, in accordance with an embodiment of the present disclosure.
Figure 5:
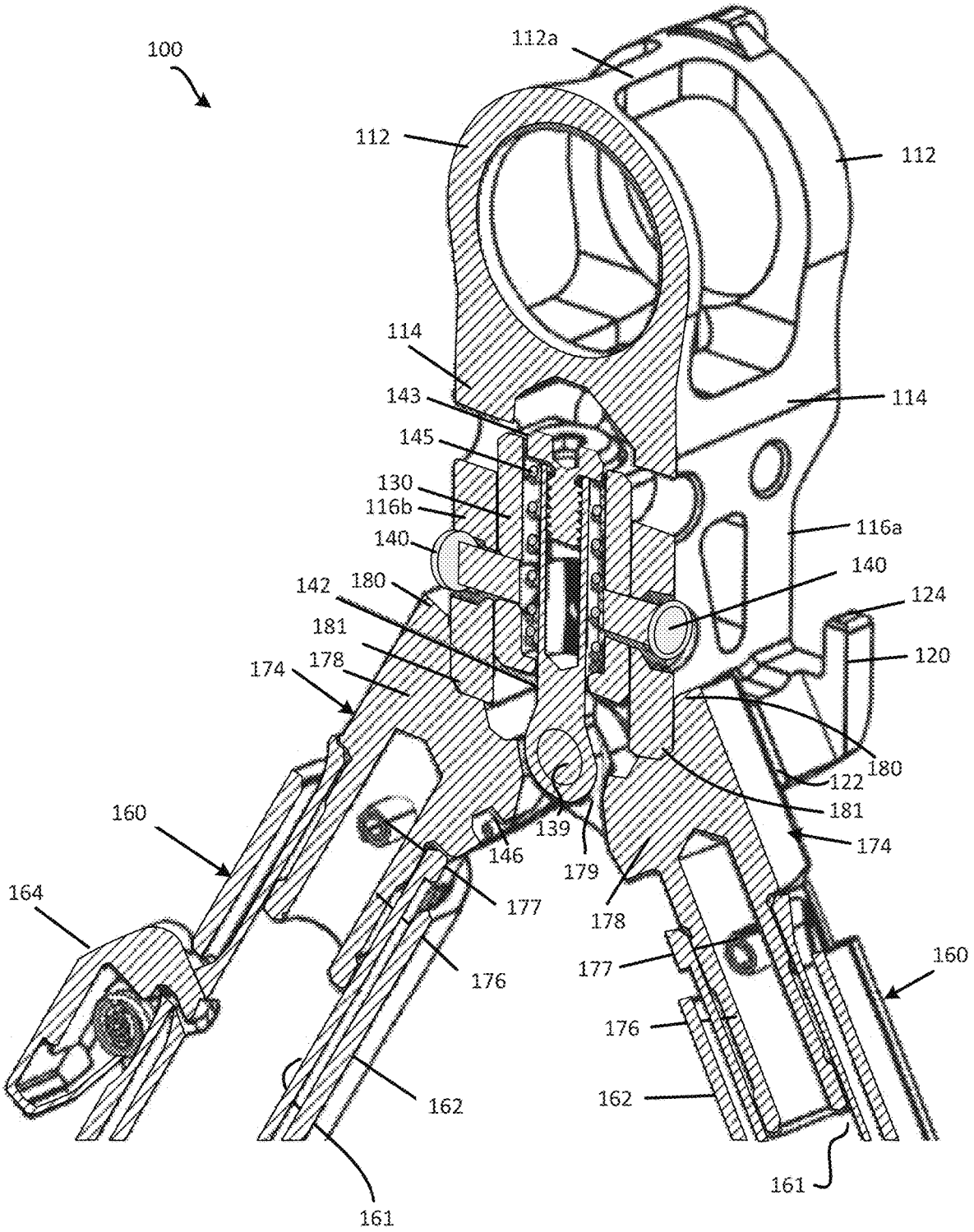
FIG. 5 is a front perspective view showing a cross section of a bipod assembly in a deployed and locked position, in accordance with an embodiment of the present disclosure.

FIGS. 1-5 illustrate a bipod assembly 100 in a deployed and locked position, in accordance with an embodiment of the present disclosure. FIG. 1 illustrates a front, perspective view of a bipod assembly 100; FIG. 2 illustrates an exploded, front perspective view of the bipod assembly 100; FIG. 3 illustrates a front view of an upper part of the bipod assembly 100; FIG. 4 illustrates a side view of an upper part of the bipod assembly 100; and FIG. 5 illustrates a front, perspective view showing a cross section of an upper part of the bipod assembly 100. FIGS. 1-5 are discussed concurrently below.

In this example, the bipod assembly 100 includes a first yoke 110 and a second yoke 130. The second yoke 130 is translatable and pivotable with respect to the first yoke 110. The first yoke 110 includes at its upper portion a collar 112 for attachment to a barrel, a gas piston housing, or a cylindrical fore end of a receiver, for example. The collar 112 in this example includes axially spaced rings sized to receive the firearm component, where the top of the rings are connected by bridge 112*a* extending axially between them. The bottom portion of the rings are connected by portions of a first yoke body 114. Other structures can be used, depending on the structure of the point of attachment. For example, the first yoke 110 can have a bracket suited for attachment to a mounting rail (e.g., a MIL-STD 1913, STANAG, or "Picatinny" rail), a plate with fastener openings, a clamp, or some other suitable attachment structure for securing the bipod assembly 100 to the firearm.

The lower portion of the first yoke 110 includes left plate 116*a* and right plate 116*b* that extend down from the first yoke body 114 generally in a parallel and spaced-apart arrangement. In this example, the first yoke body 114 is or approximates a horizontal plate. The first yoke 110 defines a channel 118 between the left plate 116*a* and right plate 116*b*. The second yoke 130 is received in the channel 118. The channel 118 is bounded at its top by the first yoke body 114 and has an open bottom end.

In this example embodiment, each plate 116 of the first yoke 110 includes feet 120 that extend laterally outward from the forward and rearward portions of the plate 116. The feet 120 on each plate 116 are spaced axially to define a gap 122 sized and shaped to receive part of the leg connector 174, which is discussed in more detail below. Each foot 120 also has a lip 124 or hook that extends upward. Part of the leg connector 174, such as a tooth 180 protruding from the connector body 178, engages an edge of the plate 116 in the locked condition. The tooth 180 can be received in a gap between the lip 124 and the plate 116 when the bipod assembly 100 is in the stowed and locked condition, thereby preventing the legs 160 from opening. Similarly, the tooth 180 of the leg connector 174 engages a bottom edge of the plate 116 between front and rear feet 120 when the bipod assembly 100 is in the deployed and locked position.

The second yoke 130 has a second yoke body 132 sized to be received in the channel 118 between the plates 116 of the first yoke 110. In this example, the second yoke body 132 generally has a trapezoidal shape as viewed from the side. Other shapes can be used, such as hemispherical or ovoid. The shape shown in the figures permits the second yoke 130 to pivot about fasteners 140 forward or back in the channel 118. For example, the fasteners 140 extend laterally through the plates 116 into an opening 134 in the second yoke body 132. Note that in place of individual fasteners 140, a single pin, a single fastener 140, a pair of pins, or cylindrical protrusions extending from opposite sides the first yoke body 132 can be used, for example.

The second yoke 130 also includes a front arm 136*a* and a rear arm 136*b* extending down from the second yoke body 132 in an axially spaced-apart, parallel relationship. The front arm 136*a* and rear arm 136*b* each define an elongated recess or through opening 138 oriented along the length of the arms 136. A hinge pin 139 is received in and extends between the openings 138. The hinge pin 139 functions as a pivot point for each leg 160 and can translate along the openings (e.g., up or down) when the second yoke 130 is moved between the locked and unlocked conditions.

The second yoke 130 defines an opening 141 through the second yoke body 132 in a direction that is parallel to the arms 136 (i.e., vertically through the second yoke body 132 when the second yoke is in the deployed position as shown in FIG. 1). A spring collar rod 142 extends through the opening 141 and is secured in the opening 141 with a screw 143 that extends into a first (upper) end of the spring collar rod 142. At its opposite second (lower) end, the spring collar rod 142 defines an eye 144 through which the hinge pin 139 passes, thereby mechanically coupling the leg connectors 174 to the second yoke 130. A spring 145 is retained around the spring collar rod 142 between the hinge pin 139 and the head of the screw 143. The spring 145, which can be a helical spring, biases the spring collar rod 142 and hinge pin 139 towards the second yoke body 132, and therefore also biases the leg connectors 174 towards the second yoke body 132. For example, in the locked position (e.g., leg connectors 174 are adjacent the second yoke body 132), the spring 145 is in a relaxed state; in an unlocked position (e.g., when the legs and second yoke 130 are moved away from the second yoke body 132) the screw 143 and spring collar rod 142 are drawn into the second yoke body 132, compressing the spring 145 between the screw 143 and the inside of the second yoke body 132, and providing a spring force to bias the hinge pin 139 towards the second yoke body 132. A torsion spring 146 has its loop around the hinge pin 139 and legs engaging each leg connector 174, such as near a junction between the connector body 178 and the stem 176. The torsion spring 146 applies a force on the legs 160 to bias the legs 160 towards the open position.

Each leg connector 174 includes a stem 176 that extends from a connector body 178. The stem 166 is sized and configured to be received in the hollow end portion of a leg 160, such as the inner tube 161 of a telescoping leg 160. The stem 166 and leg 160 can be secured together using a roll pin 177 or some other suitable fastener. The connector body 178 includes one or more hinge leaves 179 constructed to receive the hinge pin 139 so that the leg connector 174 can pivot about the hinge pin 139. An upper end of the connector body 178 defines a recess 181 and tooth 180 that is sized and shaped to engage an edge of a plate 116 of the first yoke 110. The tooth 180 protrudes from the connector body 178 and can further be configured to be received in a gap 125 between the lip 124 and plate 116 of the first yoke 110 when the bipod assembly 100 is in a stowed and locked position. In such position, the engagement between the lip 124 and tooth 180 prevent the leg connector 174 from pivoting to the open position. In the example shown, the tooth 180 is spaced laterally outward of the hinge leaves 179 and at the opposite end of the connector body 178 relative to the stem 176.

Each leg 160 includes or is configured to fasten to a leg connector 174, in accordance with some embodiments. Alternately, the leg connector 174 and leg 160 can be formed as a single component. In this example, each leg has an inner tube 161 and an outer tube 162 that can telescope to provide an adjustable leg length. The leg 160 includes a catch 164 that locks the position of the inner and outer tubes 161, 162 when moved to the locked position. In some embodiments, each catch 164 is biased to the locked position and can be released by the user pressing on the catch 164. In this example, the stem 176 of the leg connector 174 is received in an end of the inner tube 161 and secured in place using roll pin 177. In other embodiments, the leg 160 can have a fixed length. A distal end of the leg 160 can include teeth, a high-friction surface (e.g., rubber), or a foot 165 including these features, for example. Numerous variations and embodiments will be apparent in light of the present disclosure.

Figure 6A:
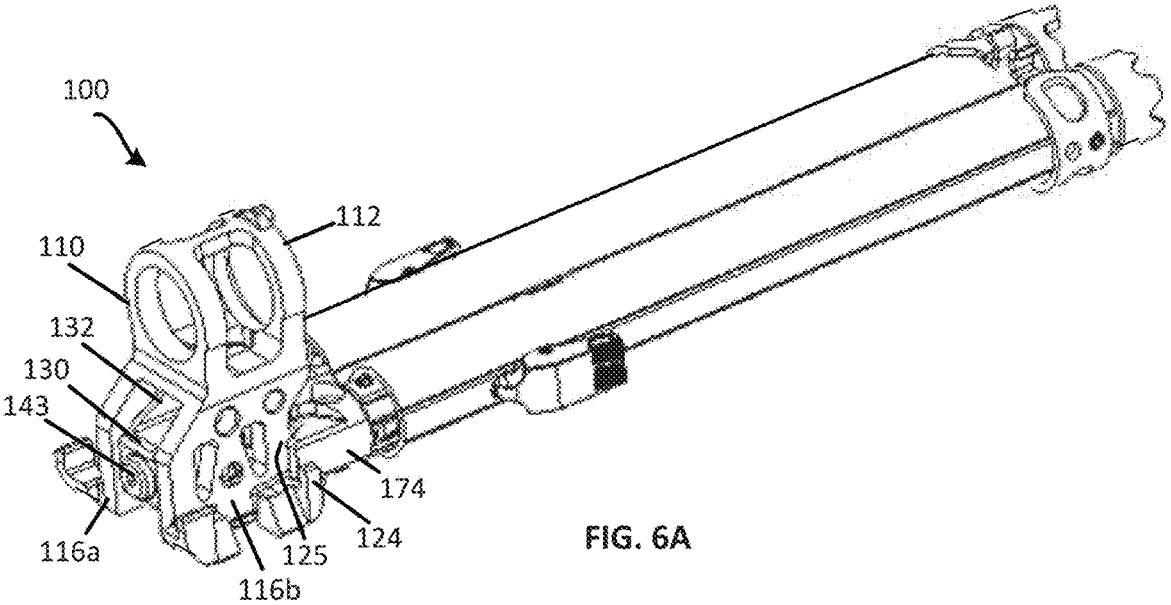
FIGS. 6A and 6B illustrate front perspective views of a bipod assembly in a rearward stowed position, in accordance with an embodiment of the present disclosure.
Figure 6B:
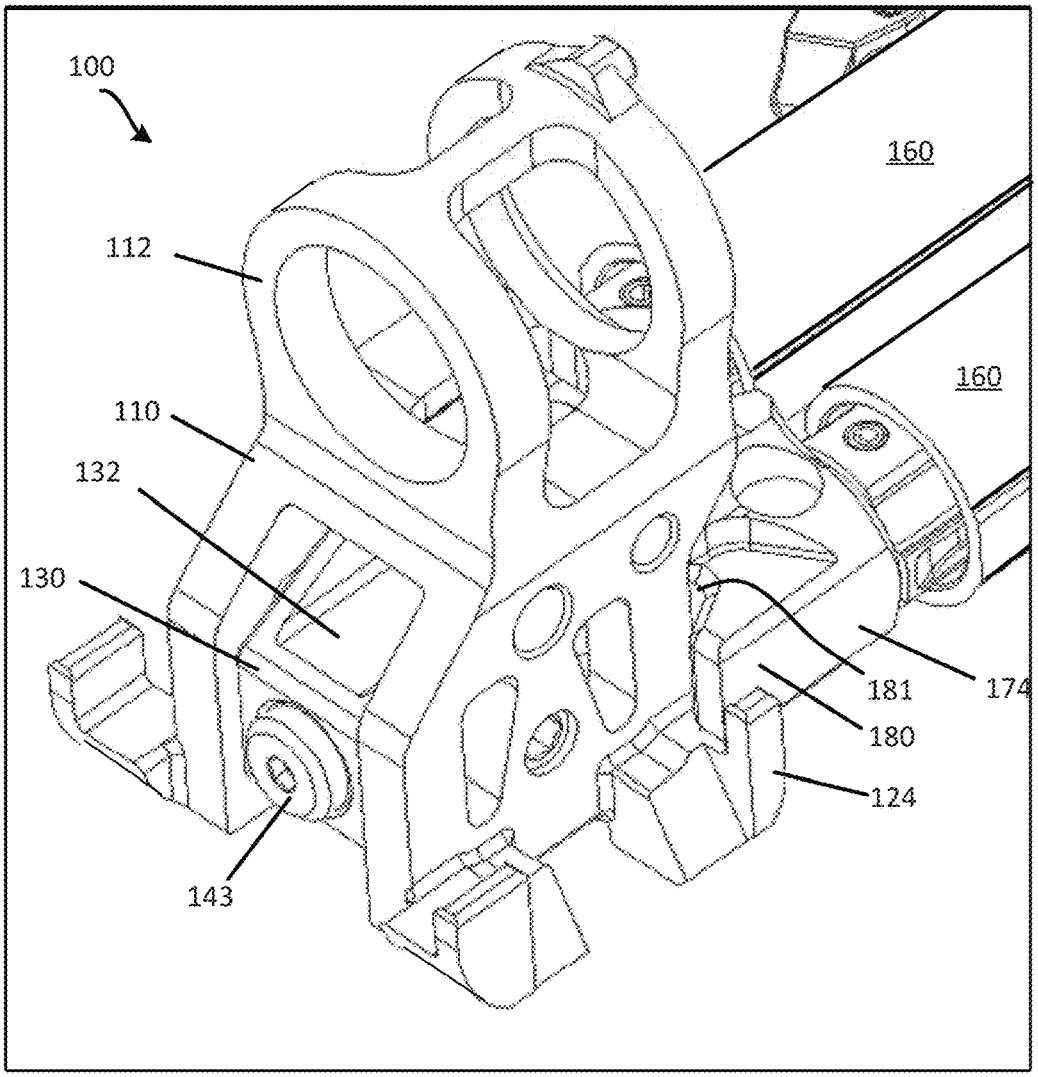

Referring now to FIGS. 6A and 6B, front and side perspective views illustrate the bipod assembly 100 in a rearward stowed and locked position, in accordance with an embodiment of the present disclosure. The first yoke 110 is generally oriented vertically with the collar 112 arranged to receive a horizontally orientated portion of the firearm. Legs 160 extend rearward of the first yoke 110 generally in parallel in a side-by-side arrangement. The second yoke 130 is rotated to a horizontal position with the arms 136 (not visible) extending rearward from the second yoke body 132 in a vertically spaced arrangement. Screw 143 can be seen at the end of the second yoke body 132.

As best seen in FIG. 6B, the rear edge of the left plate 116*b* is received in the recess 181 of the leg connector 174. Also, the tooth 180 of each leg connector 174 is received in the gap 125 between the lip 124 and plate 116*a* or 116*b* of the first yoke 110. As such, legs 160 are in a locked position and are prevented from moving to the open position. From the locked position as shown, the bipod assembly can be moved to the unlocked position by grasping the legs 160 and pulling the legs 160 rearward to disengage the leg connectors 174 from the first yoke 110.

Figure 7A:
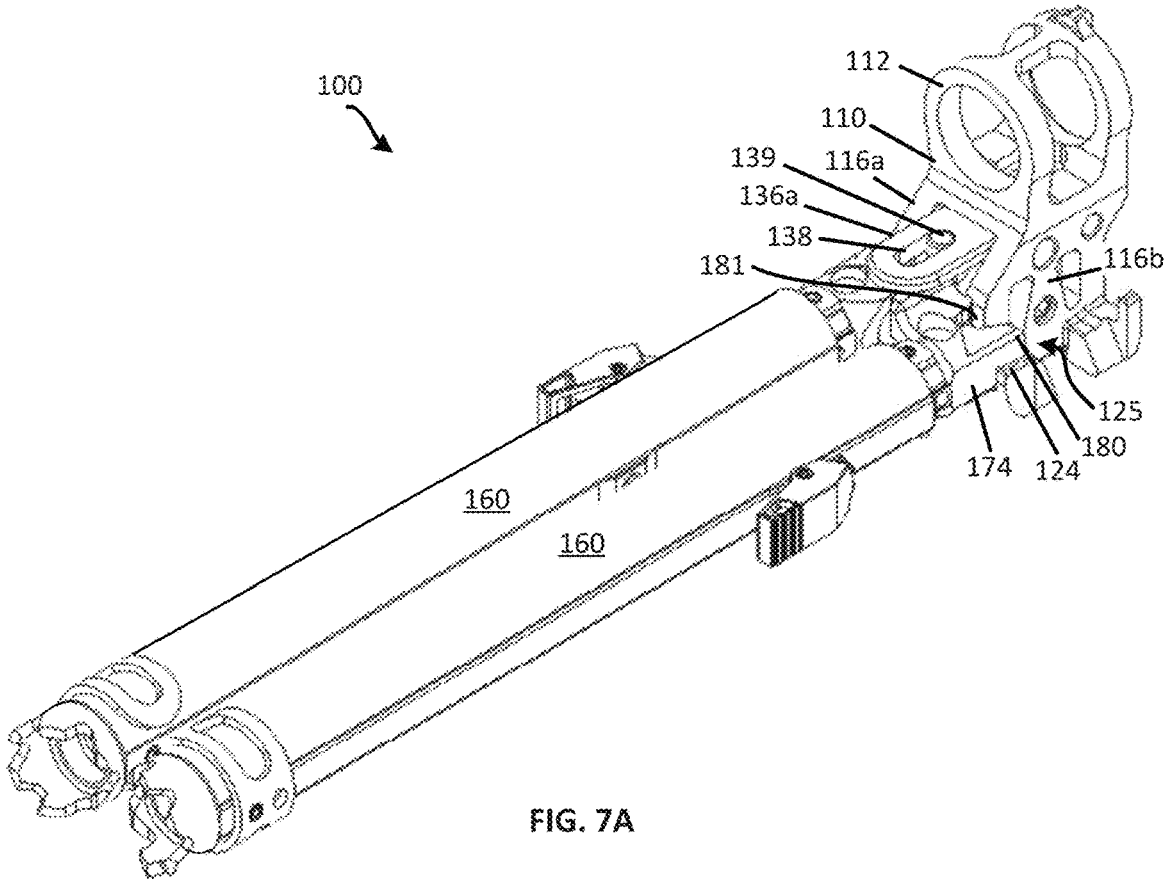
FIGS. 7A and 7B illustrate front perspective views of a bipod assembly in a forward stowed position, in accordance with an embodiment of the present disclosure.
Figure 7B:
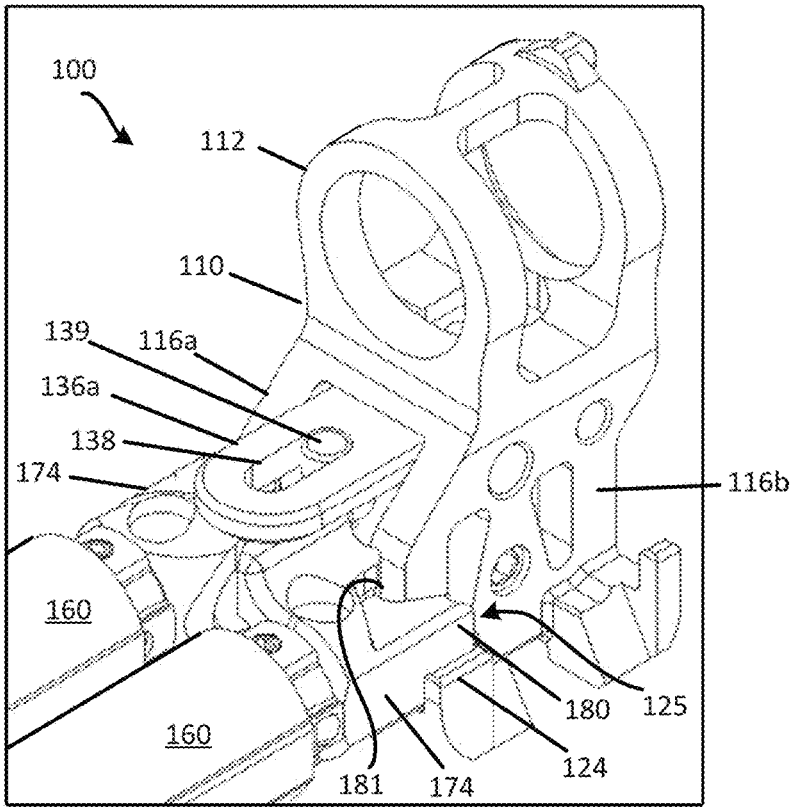

Referring now to FIGS. 7A and 7B, front and side perspective views illustrate the bipod assembly 100 in a forward stowed and locked position, in accordance with an embodiment of the present disclosure. Similar to the rearward stowed position, the first yoke 110 is generally oriented vertically with the collar 112 arranged to receive a horizontally orientated portion of the firearm. Legs 160 extend forward of the first yoke 110 generally in a parallel, side-by-side arrangement. The second yoke 130 is rotated to a horizontal position with the arms 136*a*, 136*b* extending forward in parallel from the second yoke body 132 in a vertically spaced arrangement. Note that hinge pin 139 is positioned in the elongated opening 138 against the second yoke body 132.

As best seen in FIG. 7B, the front edge of the left plate 116*b* is received in the recess 181 of the leg connector 174. Also, the tooth 180 of each leg connector 174 is received in the gap 125 between the lip 124 and plate 116*a* or 116*b* of the first yoke 110. As such, legs 160 are prevented from moving to the open position. To move the bipod assembly to the unlocked position from the forward locked position, the legs 160 can be grasped and pulled forward to disengage the leg connectors 174 from the first yoke 110.

Figure 8:
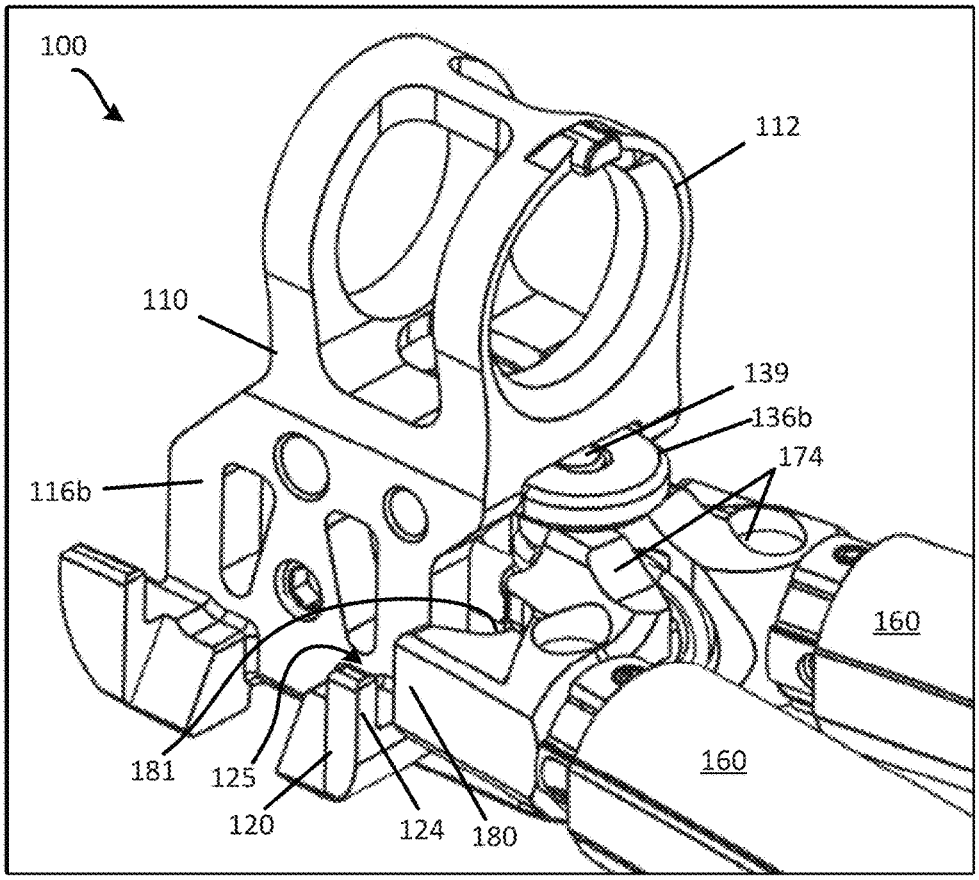
FIG. 8 illustrates a top and rear perspective view showing a bipod assembly in a rearward stowed and unlocked position, in accordance with an embodiment of the present disclosure.
Figure 9:
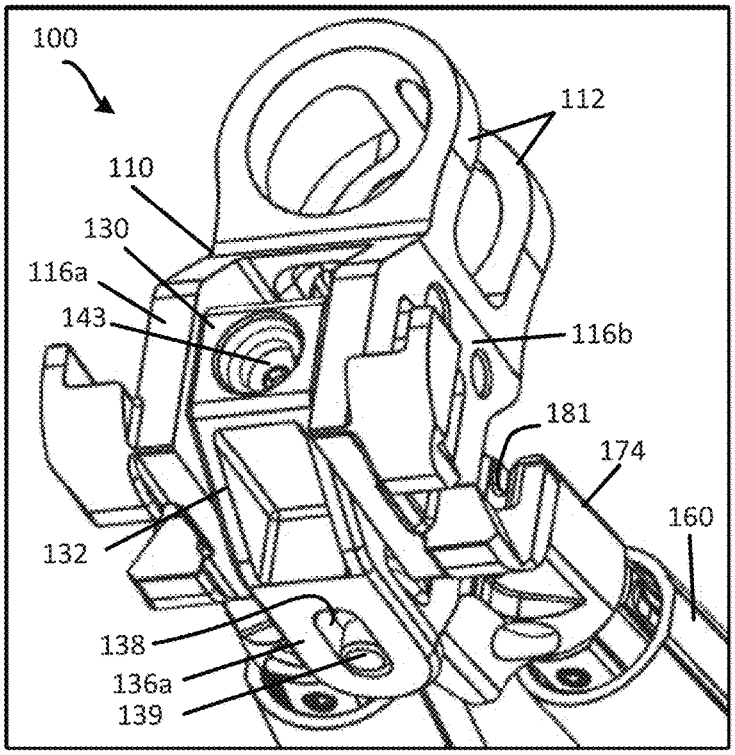
FIG. 9 illustrates a front and bottom perspective view showing a bipod assembly in a rearward stowed and unlocked position, in accordance with an embodiment of the present disclosure.

Referring now to FIGS. 8-9, perspective views show the bipod assembly 100 in an unlocked position, in accordance with an embodiment of the present disclosure. FIG. 8 is a top, side, and rear perspective view; FIG. 9 is a bottom, side, and front perspective view. In this example, the bipod assembly 100 is in an unlocked position, such as when transitioning between a rearward stowed position and a deployed position.

In this example, the first yoke 110 is generally oriented vertically with the collar 112 arranged to receive a horizontally orientated portion of the firearm. Legs 160 extend rearward of the first yoke 110 in a generally parallel relationship. The second yoke 130 is rotated to a horizontal position with the arms 136*a*, 136*b* extending rearward from the second yoke body 132 with one above the other. Note that hinge pin 139 is positioned in the elongated opening 138 at or near the end of travel away from the second yoke body 132. As can be seen in FIG. 9, the screw 143 connected to the spring collar rod 142 is recessed into the opening 141 into the second yoke body 132, causing the spring (not visible; shown in FIG. 2) to compress. In this unlocked position (e.g., pulled rearward from the locked position), the tooth 180 on each leg connector 174 is disengaged from the gap 125 between the plate 116 and lip 124 of the first yoke 110. The recess 181 on each leg connector 174 is also disengaged from the respective plate 116. In the unlocked position, the user may rotate the legs 160 downward to the deployed position since the leg connectors 174 are disengaged from the first yoke 110.

Figure 10A:
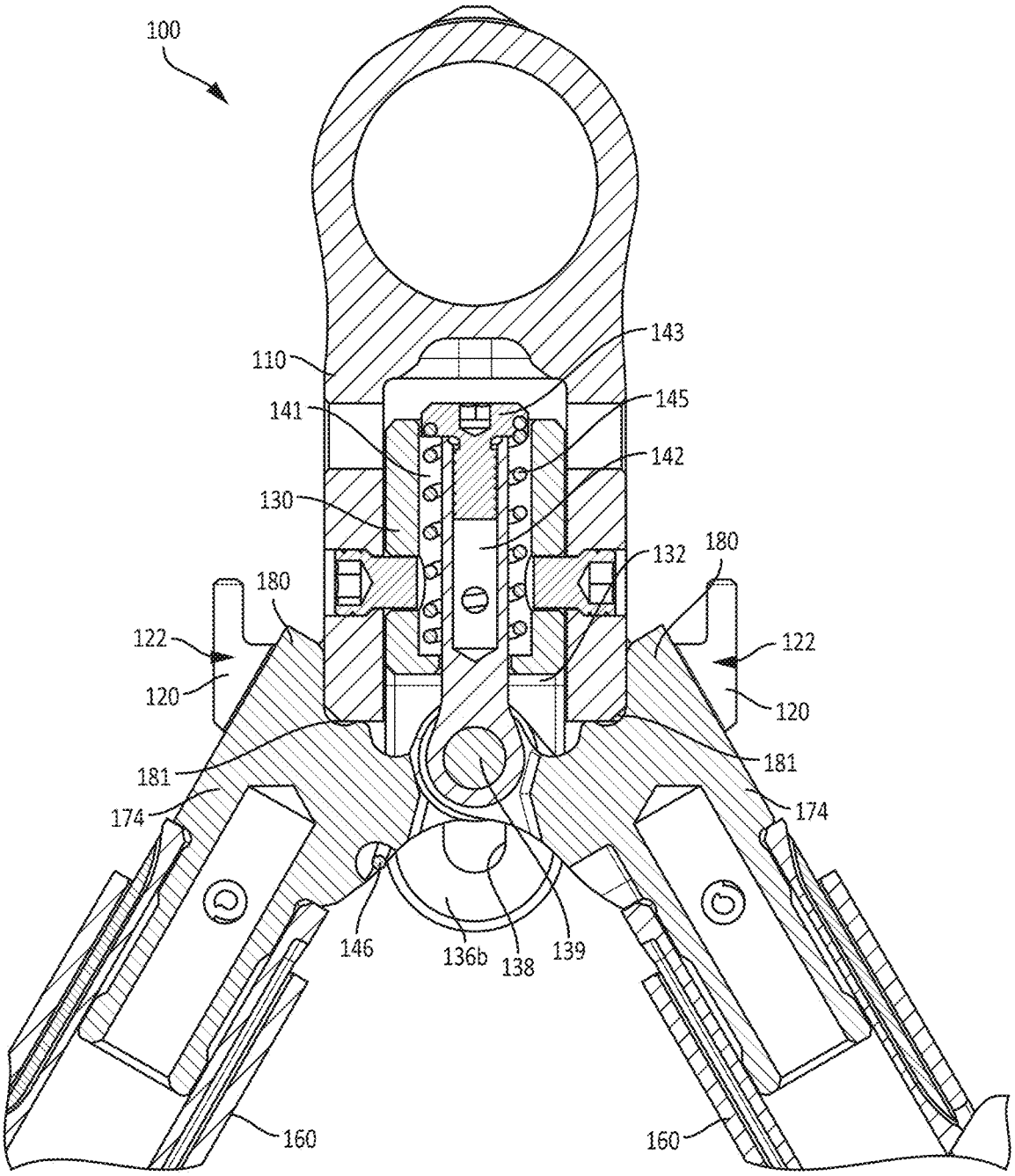
FIGS. 10A and 10B illustrate a cross-sectional front view and a front elevational view, respectively, showing an upper portion of a bipod assembly in a deployed and locked position, in accordance with an embodiment of the present disclosure.
Figure 10B:
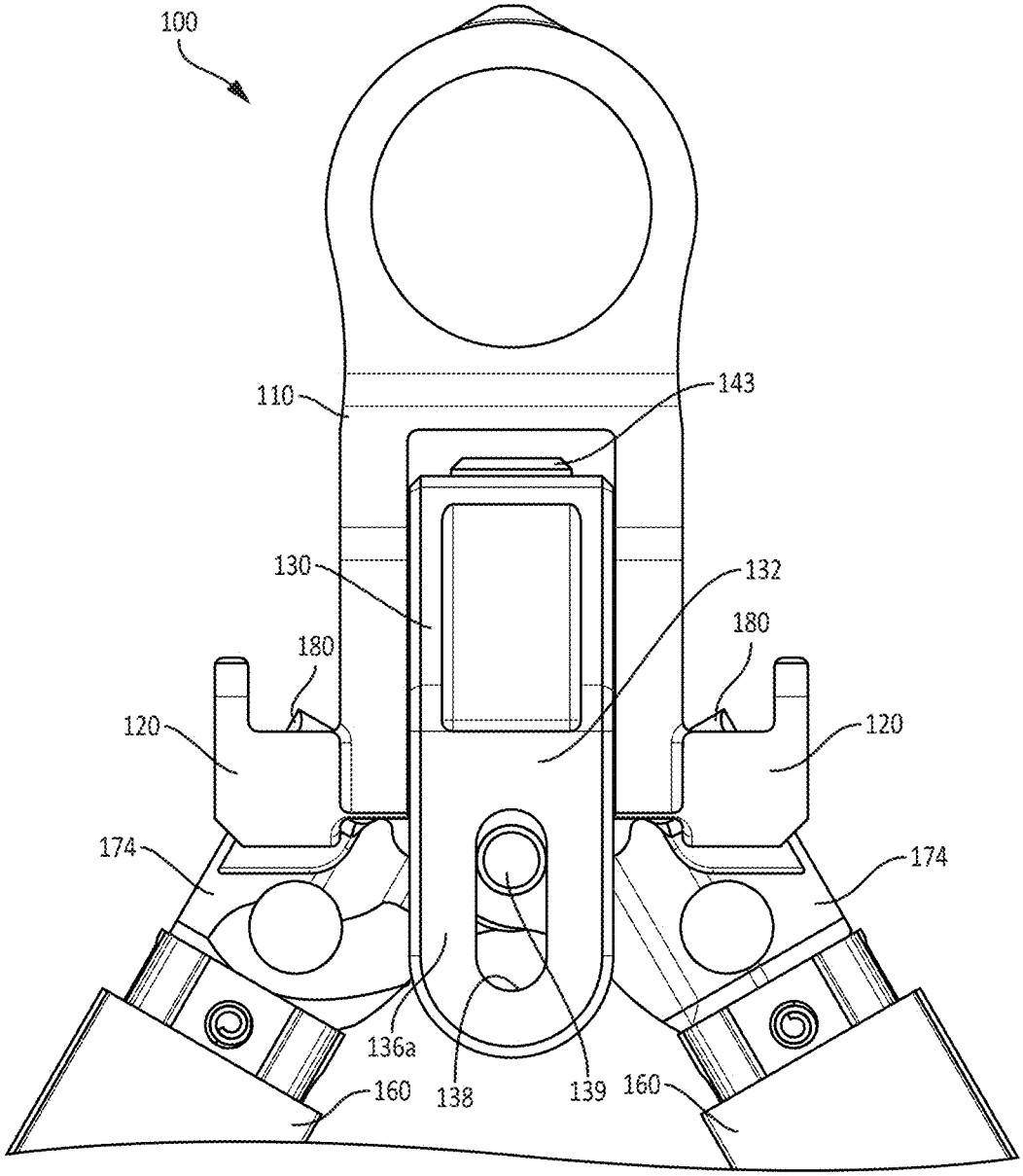

FIGS. 10A and 10B illustrates a front, cross-sectional view and a front elevational view, respectively, showing the bipod assembly 100 in a deployed and locked position, in accordance with an embodiment of the present disclosure. In this example, the hinge pin 139 is positioned in the elongated opening 138 at or near the extent of its travel towards the second yoke body 132. Legs 160 are spread apart to the open position due to a lack of a force to oppose the spring force exerted by torsion spring 146. Accordingly, leg connectors 174 are pivoted about the hinge pin 139 so that the tooth 180 of each leg connector 174 is received in the gap 122 between the front and rear feet 120 on the first yoke 110. The lower margin of the right plate 116*a* and of the left plate 116*b* is received in the recess 181 of the respective leg connector 174. Also, in this position, the spring 145 is in a relaxed state (or less compressed state) since the spring collar rod 142 and spring 145 are elevated with respect to the opening 141 in the second yoke body 132.

Figure 11A:
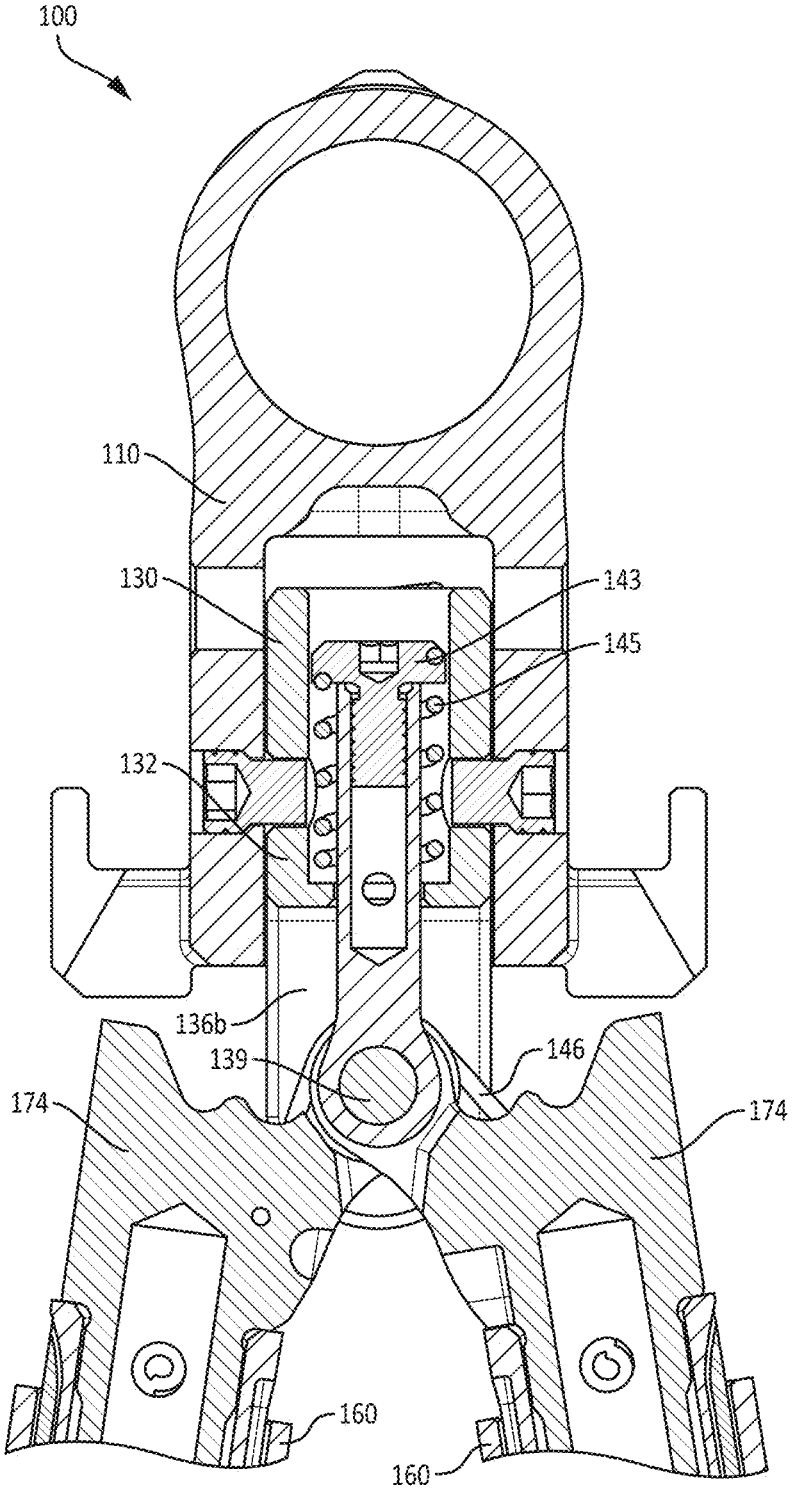
FIGS. 11A and 11B illustrate a cross-sectional front view and a front elevational view, respectively, showing an upper portion of a bipod assembly in a deployed and unlocked position, in accordance with an embodiment of the present disclosure.
Figure 11B:
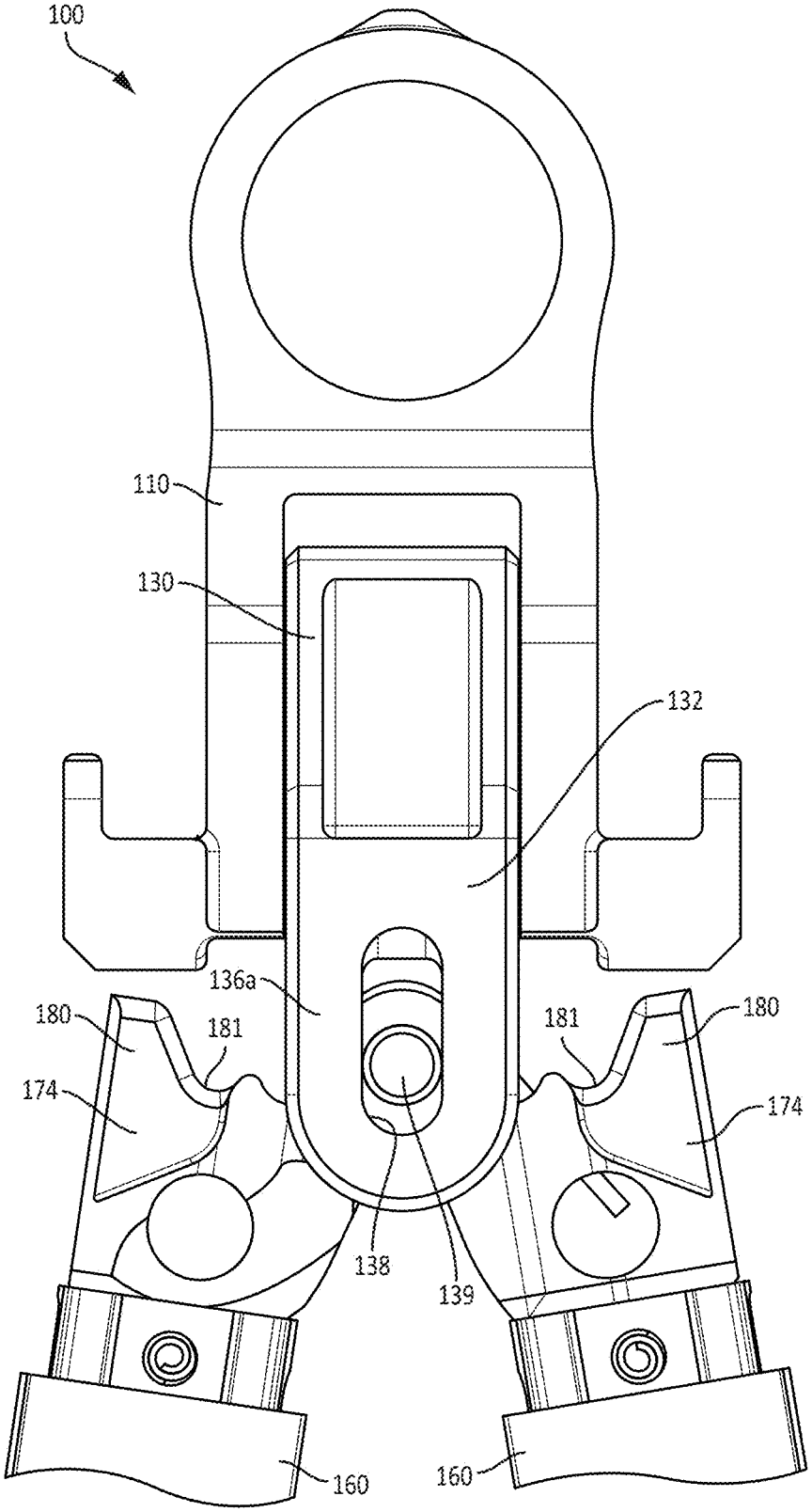

FIGS. 11A and 11B illustrates a front, cross-sectional view and a front elevational view, respectively, showing the bipod assembly in a deployed and unlocked position, in accordance with an embodiment of the present disclosure. In this example, legs 160, leg connectors 174, and hinge pin 139 have been pulled downward and away from the first yoke 110 against spring force of the spring 145 in the second yoke 130, thereby compressing the spring 145 between the screw 143 and the second yoke body 132. The hinge pin 139 is positioned in the elongated opening 138 away the second yoke body 132. Legs 160 are squeezed mostly together against the spring force exerted by torsion spring 146. Accordingly, leg connectors 174 are pivoted about the hinge pin 139 so that the tooth 180 and recess 181 of each leg connector 174 is disengaged from the first yoke 110. The lower margin of the right plate 116*a* and of the left plate 116*b* is no longer received in the recess 181 of the respective leg connector 174. In this unlocked and deployed position, the second yoke 130 is clear to rotate forward or backward to a stowed position where it is generally parallel to the barrel. Alternately, the user may release the legs 160 and allow them to assume the deployed and locked position, such as shown in FIGS. 10A and 10B.

Figure 12A:
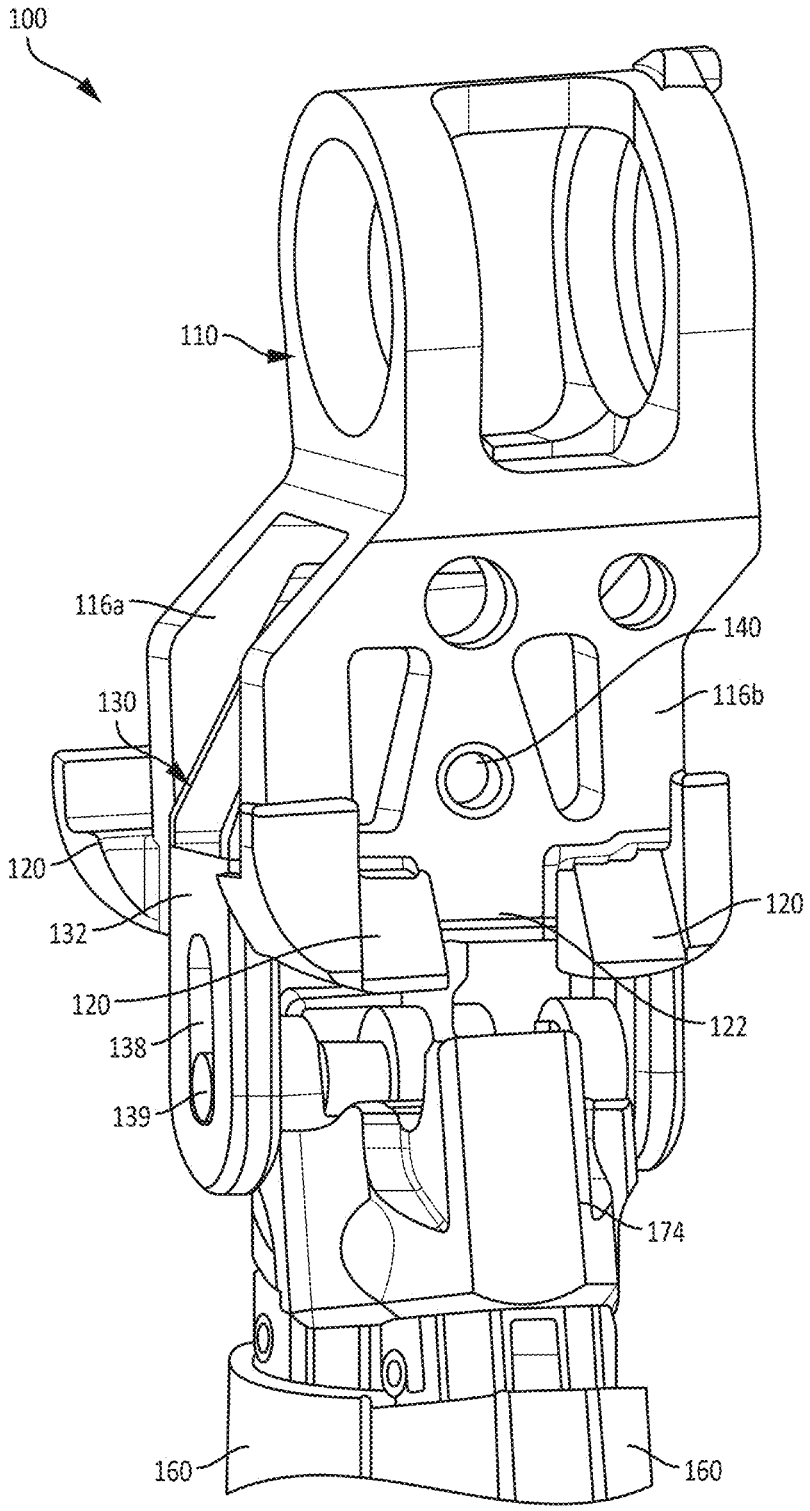
FIG. 12A illustrates a side perspective view showing a bipod assembly in a deployed and unlocked position, in accordance with an embodiment of the present disclosure.
Figure 12B:
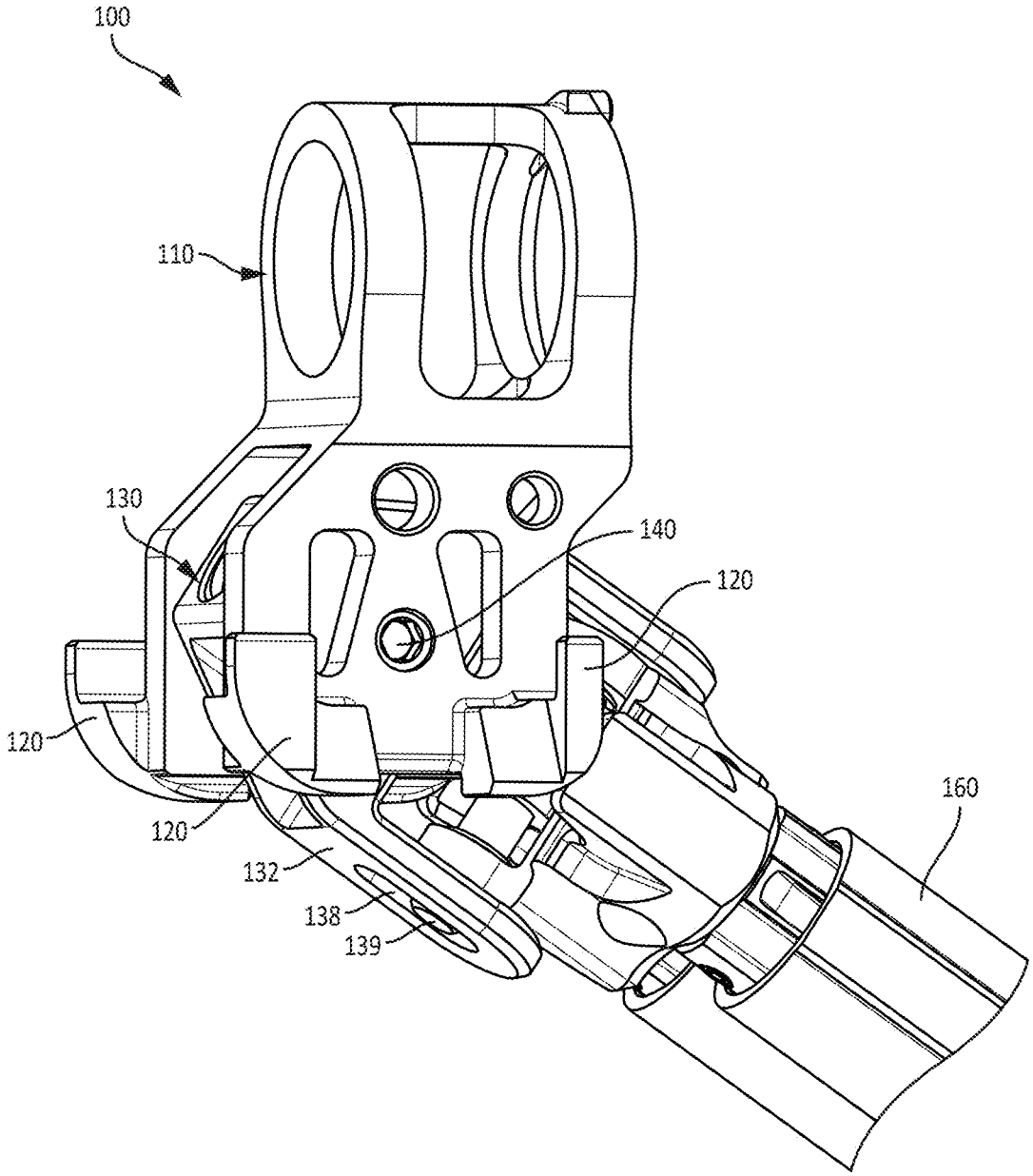
FIG. 12B illustrates a side perspective view showing the bipod assembly of FIG. 12A moved partially towards the rearward stowed position, in accordance with an embodiment of the present disclosure.
Figure 12C:
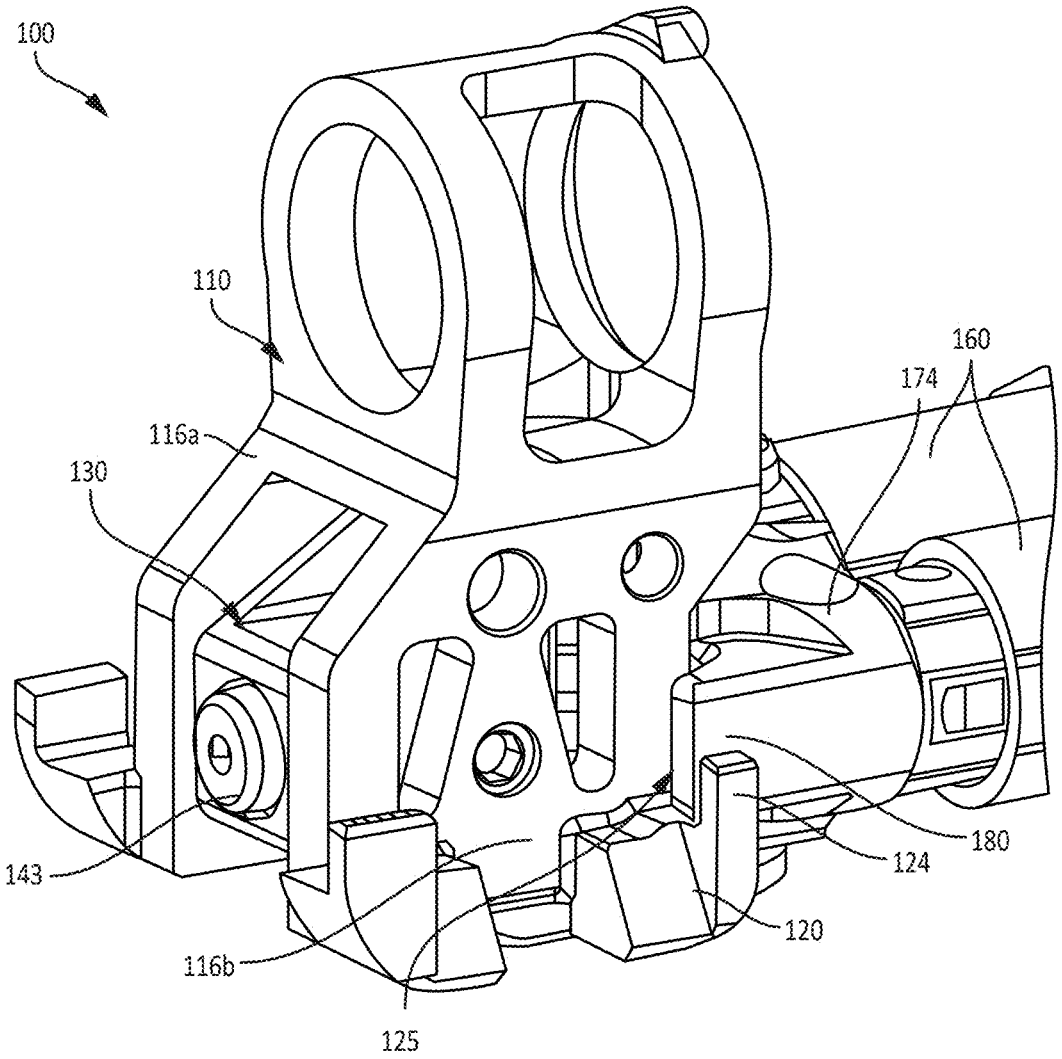
FIG. 12C illustrates a side perspective view showing a bipod assembly of FIG. 12A in a rearward stowed and locked position, in accordance with an embodiment of the present disclosure.

Referring now to FIGS. 12A-12C, side and perspective views illustrate a bipod assembly 100 moving from an unlocked and deployed position (FIG. 12A) to an intermediate position (FIG. 12B) and to a rearward stowed position (FIG. 12C), in accordance with some embodiments. In FIG. 12A, the bipod assembly 100 is in an unlocked and deployed position with the second yoke 130 rotated so that the front and rear arms 136*a*, 136*b* extend downward. The legs 160 have been moved away from the second yoke body 132, such as by grasping the legs 160 to draw them together and then pulling down on the legs. In this unlocked position, the hinge pin 139 has been drawn away from the second yoke body 132 to the extent of its travel in the elongated openings 138. As such, the leg connectors 174 are disengaged from the gap 122 between the feet 120 at the front and rear portions of the right and left plates 116*a*, 116*b* of the first yoke 110. Accordingly, the second yoke 103 is unobstructed and can be pivoted forward or rearward about fasteners 140.

In FIG. 12B, the second yoke 130 has been partially pivoted towards the rearward stowed position. The leg connectors 174 just clear the rounded corner of the foot 120 at the rear end portion of each of the right and left plates 116*a*, 116*b*. In this example, feet 120 at the front and rear portions of the plates 116 are rounded at the corner to provide clearance for the leg connectors 174. For example, the rounded profile has a radius about equal to the distance to the pivot axis through fasteners 140. The hinge pin 139 remains positioned away from the second yoke body 132, where the hinge pin 139 is at or close to the limits of travel in the elongated openings 138 (e.g., slots).

In FIG. 12C, the bipod assembly 100 is in a rearward stowed and locked position. The front and rear arms 136*a*, 136*b* of the second yoke 130 as well as the legs 160 extend rearwardly. Note that the legs 160 and leg connectors 174 have resumed their locked position towards the second yoke body 132. In doing so, the tooth 180 on each leg connector 174 occupies the gap 125 between the lip 124 of the foot 120 and the plate 116. In this position, the legs 160 cannot pivot downward nor can they pivot open. Also, as a result of being in the locked position, the screw 143 in the second yoke 130 protrudes slightly from the second yoke 130.

In use, a bipod assembly 100 as variously disclosed herein enables the user to move the bipod between deployed and stowed positions more easily than existing bipod assemblies, such as using only one hand. In addition, the bipod assembly 100 provides improved reliability in maintaining the deployed or stowed position. When the bipod assembly 100 is in a stowed and locked position, for example, the assembly resists inadvertent deployment due to locking structures between the legs 160 and the first yoke 110 (e.g., teeth 180 and gap 125 between plate and lip). Similarly, when the bipod assembly 100 is in a deployed and locked position, the assembly resists inadvertent movement to the stowed position due to locking structures between the legs 160 and first yoke 110 (e.g., teeth 180 and gap 122 between feet 120).

With the legs 160 drawn together, the user can pull the legs 160 away from the second yoke body 132 to translate the hinge pin 139 along elongated openings 138 in the second yoke 130. This movement unlocks the assembly. In doing so, the teeth 180 on leg connectors 174 at the upper ends of each leg 160 disengage from the right and left plates 116*a*, 116*b* on the first yoke 110 and allow the second yoke 130 and legs 160 to pivot between stowed and deployed positions. When the user releases the legs 160, either in a stowed position or in the deployed position, the legs 160 are biased towards an open position and the second yoke 130 is biased toward the proximal or locked position.

Although leg connectors 174 and feet 120 on the first yoke 110 have been disclosed for this purpose, other structures can be used. The leg 160 or leg connector 174 can include a pin that is received in a recess associated with each position. Also, the present disclosure contemplates the bipod assembly 100 having more than one deployed position. For example, the locking structures on the first yoke can be arranged to provide for two or more deployed positions, such as a first deployed position with the legs at 90° with respect the rifle's bore axis and a second deployed position at 100° or 105°. Numerous variations and embodiments will be apparent in light of the present disclosure.

FURTHER EXAMPLE EMBODIMENTS

The following examples pertain to further embodiments, from which numerous permutations and configurations will be apparent.

Example 1 is bipod assembly that includes a first yoke and a second yoke. The first yoke has a first body with a connector portion configured to attach to a rifle and has left and right plates extending away from the connector portion in a spaced-apart and generally parallel relationship. The second yoke has a second yoke body pivotably connected to the first yoke between the left and right plates of the first body, the second yoke including front and rear arms extending away from the second yoke body in a spaced-apart and generally parallel relationship. Right and left legs are pivotably connected to the second yoke by a pin extending between the front and rear arms, where the pin is biased towards the second yoke body and is movable against a bias force away from the second yoke body along the front and rear arms.

Example 2 includes the bipod assembly of Example 1, where the right and left legs are biased laterally outward toward an open position.

Example 3 includes the bipod assembly of Examples 1 or 2, where the front and rear arms of the second yoke each define a slot and wherein the pin is received in the slot.

Example 4 includes the bipod assembly of any one of Examples 1-3, wherein the right and left legs are movable among a forward stowed position, a rearward stowed position, and a deployed position.

Example 5 includes the bipod assembly of any one of Examples 1-4, where the first yoke includes spaced-apart front and rear left feet protruding laterally outward from the left plate, the first yoke includes spaced-apart front and rear right feet protruding laterally outward from the right plate, the first yoke defines a left gap between each of the front and rear left feet and the left plate, the first yoke defines a right gap between each of the front and rear right feet and the right plate, and in a stowed and locked position part of the left leg is received in the left gap and part of the right leg is received in the right gap.

Example 6 includes the bipod assembly of Example 5, where in a deployed and locked position, part of the right leg is received between the spaced-apart front and rear right feet on the right plate and part of the left leg is received between the spaced-apart front and rear left feed on the left plate.

Example 7 includes the bipod assembly of Example 6, where in the deployed and locked position, part of the leg engages an edge of a respective one of the left and right plates, thereby preventing the right and left legs from pivoting to a closed leg position.

Example 8 includes the bipod assembly of any one of Examples 1-4, where the first yoke includes a left foot protruding laterally outward from the left plate and defines a left gap between the left plate and the left foot, the first yoke includes a right foot protruding laterally outward from the right plate an defines a right gap between the right foot and the right plate, the left leg includes a tooth configured to be received in the left gap when left leg is in a stowed and locked position, and the right leg includes a tooth configured to be received in the right gap when the right leg is in a stowed and locked position.

Example 9 includes the bipod assembly of Example 8, wherein when in the stowed and locked position, moving the right and left legs away from the second yoke body (e.g., pulling rearward along the rifle's barrel) disengages the tooth on the right leg from the right gap and disengages the tooth on the left leg from the left gap, thereby permitting the right and left legs to pivot to a deployed position.

Example 10 includes the bipod assembly of Example 9, wherein disengaging the tooth on the right leg and disengaging the tooth on the left leg permits moving the right and left legs to an open position.

Example 11 includes the bipod assembly of any one of Examples 1-10, where the connector portion of the first yoke comprises a ring configured to receive a cylindrical portion of the rifle.

Example 12 is a rifle comprising the bipod assembly of any one of Examples 1-11, where the connector portion is secured to a fore end of the rifle.

Example 13 includes the rifle of Example 12, wherein the rifle is a machine gun or long-range rifle.

Example 14 is a rifle bipod assembly that includes a first yoke configured to be attached to a firearm, a second yoke pivotably attached to the first yoke, and a right leg and a left leg each pivotably connected to the second yoke and movable between an open position and a closed position. The bipod assembly is movable between a stowed and locked position, an unlocked position, and a deployed and locked position.

Example 15 includes the rifle bipod assembly of Example 14, wherein in the stowed and locked position connectors on each of the right leg and left leg engage the first yoke, thereby preventing the right leg and the left leg from moving to the open position and also preventing the second yoke from pivoting with respect to the first yoke. In the deployed and locked position, the connectors on each of the right leg and the left leg engage the first yoke, thereby preventing the right leg and the left leg from moving to the closed position and also preventing the second yoke from pivoting with respect to the first yoke.

Example 16 includes the rifle bipod assembly of Example 15, where drawing the legs away from the second yoke moves the bipod assembly to the unlocked position.

Example 17 includes the rifle bipod assembly of Example 14 or 15, wherein the first yoke includes a left foot protruding laterally outward and defining a left gap between the left foot and part of the first yoke, the first yoke includes a right foot protruding laterally outward and defining a right gap between the right foot and part of the first yoke, the left leg includes a tooth configured to be received in the left gap when left leg is in a locked position, and the right leg includes a tooth configured to be received in the right gap when the right leg is in a locked position.

Example 18 is a method of deploying a rifle bipod, the method comprising providing a bipod assembly having a first yoke attachable to a firearm, a second yoke pivotable with respect to the first yoke, and right and left legs each pivotably connected to the second yoke, wherein the bipod assembly is movable between a stowed and locked position, a stowed and unlocked position, a deployed and unlocked position, and a deployed and locked position, and wherein the right and left legs are pivotable between an open position and a closed position; drawing the right and left legs rearward from the stowed and locked position, thereby moving the right and left legs to the stowed and unlocked position; pivoting the right and left legs downward to a deployed and unlocked position; and releasing the right and left legs, thereby allowing the right and left legs to assume an open position and the second yoke to move towards and engage the first yoke in the deployed and locked position.

Example 19 includes the method of Example 18 and further includes squeezing together the right and left legs from the open position to the closed position; pulling the right and left legs away from the second yoke to the deployed and unlocked position; pivoting the right and left legs upward to the stowed and unlocked position; and releasing the right and left legs, thereby permitting the right and left legs to move towards the second yoke and engage the first yoke in the stowed and locked position.

Example 20 includes the method of Example 19, where pivoting the right and left legs upward includes pivoting the right and left legs either rearward and upward or forward and upward.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A bipod assembly comprising:

a first yoke having a first body with a connector portion configured to attach to a rifle, and having left and right plates extending away from the connector portion in a spaced-apart and generally parallel relationship;

a second yoke with a second yoke body pivotably connected to the first yoke between the left and right plates of the first body, the second yoke including front and rear arms extending away from the second yoke body in a spaced-apart and generally parallel relationship; and right and left legs pivotably connected to the second yoke by a pin extending between the front and rear arms, wherein the pin is biased towards the second yoke body and is movable against a bias force away from the second yoke body along the front and rear arms.

2. The bipod assembly of claim 1, wherein the right and left legs are biased laterally outward toward an open position.

3. The bipod assembly of claim 1, wherein the front and rear arms of the second yoke each define a slot and wherein the pin is received in the slot.

4. The bipod assembly of claim 1, wherein the right and left legs are movable among a forward stowed position, a rearward stowed position, and a deployed position.

5. The bipod assembly of claim 1, wherein:

the first yoke includes front and rear left feet spaced apart on the left plate and protruding laterally outward from the left plate;

the first yoke includes front and rear right feet spaced apart on the right plate and protruding laterally outward from the right plate;

the first yoke defines a left gap between the left plate and each of the front and rear left feet;

the first yoke defines a right gap between the right plate and each of the front and rear right feet; and in a stowed and locked position, part of a left leg is received in the left gap and part of a right leg is received in the right gap.

6. The bipod assembly of claim 5, wherein in a deployed and locked position, part of the right leg is received between the front and rear right feet on the right plate and part of the left leg is received between the front and rear left feed on the left plate.

7. The bipod assembly of claim 6, wherein in the deployed and locked position, part of the right leg and part of the left leg engage an edge of a respective one of the left and right plates, thereby preventing the right and left legs from pivoting to a closed leg position.

8. The bipod assembly of claim 1, wherein:

the first yoke includes a left foot protruding laterally outward from the left plate and defining a left gap between the left plate and the left foot;

the first yoke includes a right foot protruding laterally outward from the right plate and defining a right gap between the right foot and the right plate;

the left leg includes a tooth configured to be received in the left gap when left leg is in a stowed and locked position; and the right leg includes a tooth configured to be received in the right gap when the right leg is in a stowed and locked position.

9. The bipod assembly of claim 8, wherein when in the stowed and locked position moving the right and left legs away from the second yoke body disengages the tooth on the right leg from the right gap and disengages the tooth on the left leg from the left gap, thereby permitting the right and left legs to pivot to a deployed position.

10. The bipod assembly of claim 9, wherein disengaging the tooth on the right leg and disengaging the tooth on the left leg permits moving the right and left legs to an open position.

11. The bipod assembly of claim 1, wherein the connector portion of the first yoke comprises a ring configured to receive a cylindrical portion of the rifle.

12. A rifle comprising the bipod assembly of claim 1, wherein the connector portion is secured to a fore end of the rifle.

13. The rifle of claim 12, wherein the rifle is a machine gun.

14. A rifle bipod assembly comprising:

a first yoke configured to be attached to a firearm;

a second yoke pivotably attached to the first yoke; and a right leg and a left leg each pivotably connected to the second yoke and movable between an open position and a closed position;

wherein the bipod assembly is movable between a stowed and locked position, an unlocked position, and a deployed and locked position, and wherein: in the stowed and locked position, the right leg and left leg engage the first yoke, thereby preventing the right leg and the left leg from moving to the open position and preventing the second yoke from pivoting with respect to the first yoke; and in the deployed and locked position, the right leg and the left leg engage the first yoke, thereby preventing the right leg and the left leg from moving to the closed position and preventing the second yoke from pivoting with respect to the first yoke.

15. The rifle bipod assembly of claim 14, wherein drawing the legs away from the second yoke moves the bipod assembly to the unlocked position.

16. A rifle bipod assembly comprising:

a first yoke configured to be attached to a firearm;

a second yoke pivotably attached to the first yoke; and a right leg and a left leg each pivotably connected to the second yoke and movable between an open position and a closed position;

wherein the bipod assembly is movable between a stowed and locked position, an unlocked position, and a deployed and locked position, and wherein: the first yoke includes a left foot protruding laterally outward and defining a left gap between the left foot and part of the first yoke; the first yoke includes a right foot protruding laterally outward and defining a right gap between the right foot and part of the first yoke; the left leg includes a tooth configured to be received in the left gap when left leg is in the stowed and locked position; and the right leg includes a tooth configured to be received in the right gap when the right leg is in the stowed and locked position.

* * * * *